US005263673A

United States Patent [19]

Yang

[11] Patent Number: 5,263,673

[45] Date of Patent: Nov. 23, 1993

[54] BABY NURSING FRAME ASSEMBLY

[76] Inventor: Feng-Hui Yang, 1 Fl., No. 261, Sec. 2, Tungmen Rd., Tainan, Taiwan, Taiwan

[21] Appl. No.: 889,248

[22] Filed: May 28, 1992

[51] Int. Cl.[5] ..... A47D 15/00

[52] U.S. Cl. ..... 248/103; 248/106; 5/603

[58] Field of Search ..... 248/103, 104, 105, 106, 248/289.1, 291; 5/603, 658

[56] References Cited

U.S. PATENT DOCUMENTS

| | | | |
|---|---|---|---|
| 932,128 | 8/1909 | Houston | 248/104 |
| 1,178,594 | 4/1916 | Nixon | 248/103 |
| 1,911,901 | 5/1933 | Keane et al. | 248/103 |
| 2,499,930 | 3/1950 | Seiger | 248/103 |
| 5,092,549 | 3/1992 | Beech | 248/103 |

*Primary Examiner*—Hien H. Phan
*Assistant Examiner*—Kenneth E. Peterson
*Attorney, Agent, or Firm*—Varndell Legal Group

[57] ABSTRACT

A baby nursing frame assembly comprised of two arched mounting plates fastened to a baby's bed at two opposite sides, two supporting bars pivoted to the baby's bed at two opposite sides and locked to the two arched mounting plates by lock nuts, and a suspension frame, which has a ring at the middle for holding a nursing bottle and two opposite ends bent at right angles and respectively inserted into the boring bore on each supporting bar and locked in place by lock screws. By loosening the lock nuts, the supporting bars and the suspension frame can be folded down; by loosening the lock screws, the suspension frame can be adjusted to the desired level.

1 Claim, 3 Drawing Sheets

BABY NURSING FRAME ASSEMBLY

BACKGROUND OF THE INVENTION

The present invention relates to a frame assembly mounted on a baby's bed to hold a nursing bottle which can be conveniently adjusted into operative position to feed a milk, liquid food, etc. to a baby.

In feeding a milk, juice, etc. to a newborn child by a nursing bottle, the newborn child's mother or the nurse should help the newborn child hold the nursing bottle, or the nursing bottle may drop from the newborn child's hands. In nursing rooms, a nurse shall have to take care of several newborn children. However, a nurse can not simultaneously nurse several newborn children. Therefore, much time is wasted in nursing newborn children.

SUMMARY OF THE INVENTION

The present invention has been accomplished under the aforesaid circumstances. It is therefore the main object of the present invention to provide a baby nursing frame assembly which can be conveniently fastened to a baby's bed to hold a nursing bottle for feeding a milk, liquid food, etc. to a baby. It is another object of the present invention to provide a baby nursing frame assembly which can be conveniently adjusted to the desired level conveniently for nursing a baby. It is still another object of the present invention to provide a baby nursing frame assembly which can be folded down when not in use.

BACKGROUND OF THE INVENTION

DETAILED DESCRIPTION OF THE PREFERRED EMBODIMENT

Figure 1:
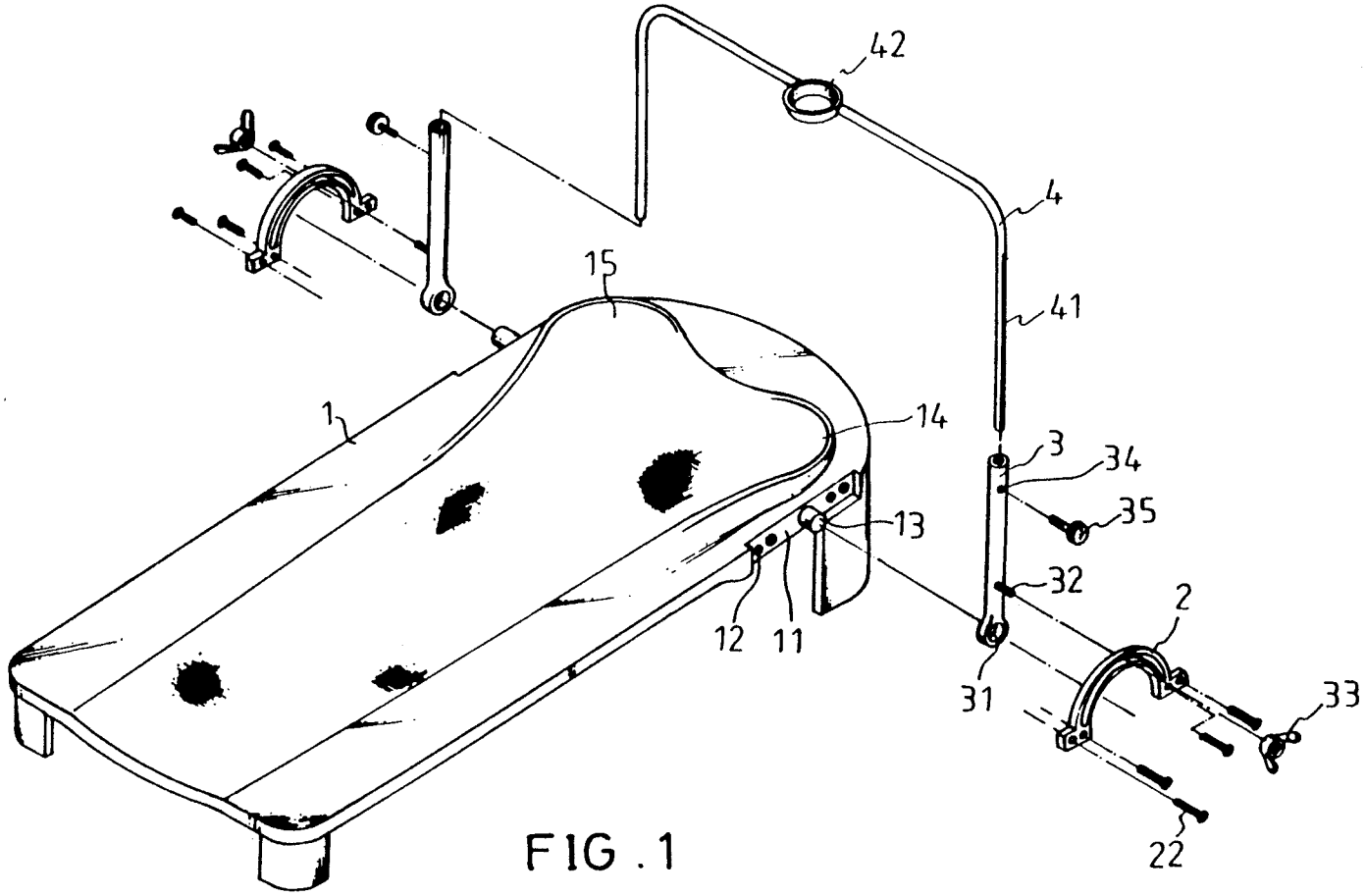
FIG. 1 is an exploded view of the preferred embodiment of the present invention.
Figure 2:
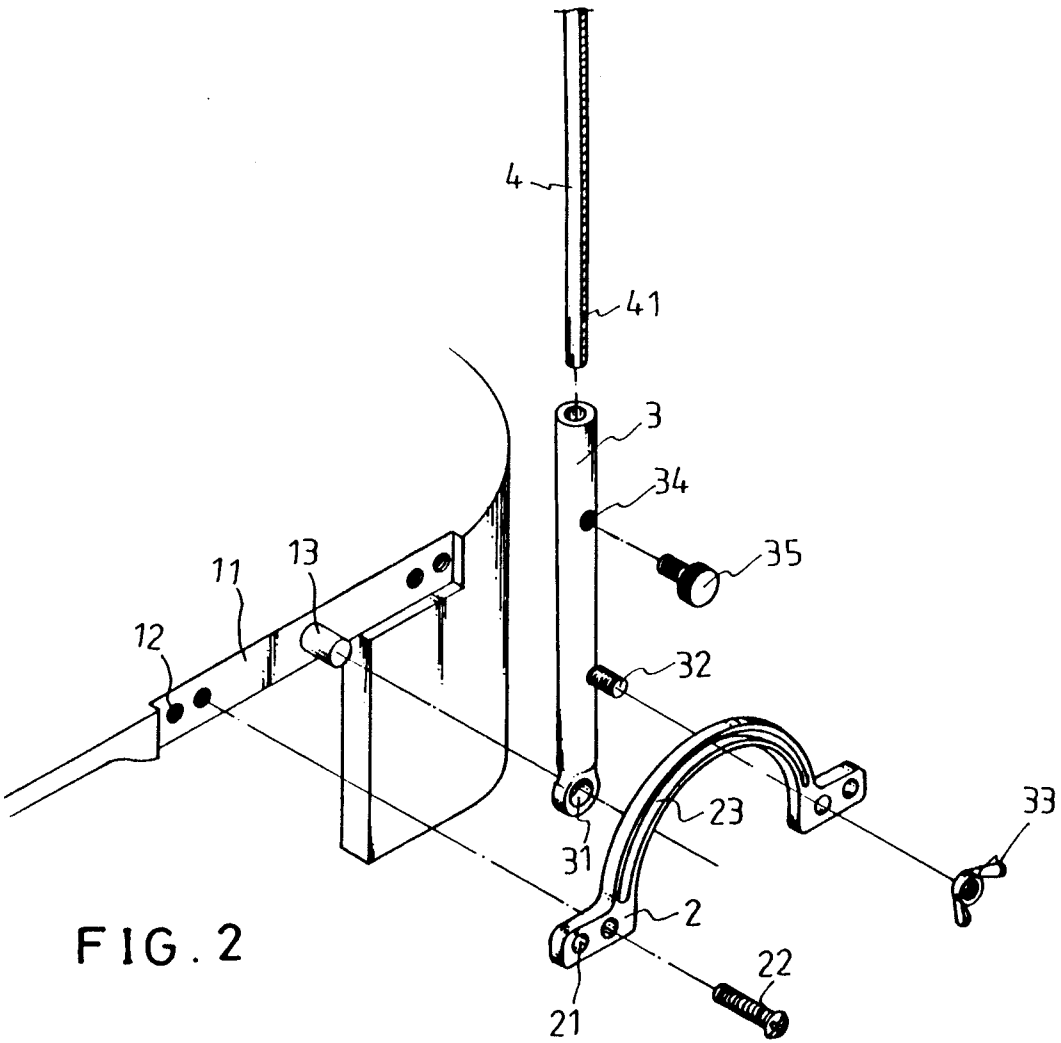
FIG. 2 is a partly exploded view thereof in enlarged scale.

Referring to FIGS. 1 and 2, the preferred embodiment of the frame assembly of the present invention is generally comprised of two arched mounting plates 2 fastened to a baby's bed 1 at two opposite sides, a suspension frame 4, and two supporting bars 3 to connect the suspension frame 4 to the arched mounting plates 2. The baby's bed 1 is orthopedically engineered. The head of the baby's bed 1 is relatively higher than the foot thereof. Two curved supporting flanges 14,15 are raised from the top edge of the baby's bed 1 at two opposite locations near the head thereof, which supports the baby and prohibits him (her) from extending out his (her) hands to touch the frame assembly. Two elongated grooves 11 are respectively made on the two opposite long sides of the baby's bed 1 near the head thereof. A pin 13 and at least one pair of opposite bolt holes 12 are made on each elongated groove 11 for fastening either arched mounting plate 2 and either supporting bar 3. Each arched mounting plate 2 has at least one pair of opposite round holes 21 respectively connected to the at least one pair of opposite bolt holes 12 on either side of the baby's bed 1 by screws 22, and an arched sliding track 23 through the body thereof. Each supporting bar 3 is made from a tube having one end, namely, the bottom end thereof formed into an eye 31, into which the pin 13 fits. Each supporting bar 3 also comprises a screw rod 32 above the eye 31, which is inserted through the arched sliding track 23 on either arched mounting plate 2 and locked in place by a wing nut 33 when the eye 31 has been mounted on the pin 13, and a bolt hole 34 near the top end thereof, into which a lock screw 35 is threaded to lock the suspension frame 4 in place. The suspension frame 4 comprises a nursing bottle holding ring 42 at the middle for holding a nursing bottle, and two elongated connecting rods 41 at two opposite ends at right angles respectively inserted into the boring bore of either supporting bar 3 and locked in place by the lock screw 35.

Figure 3:
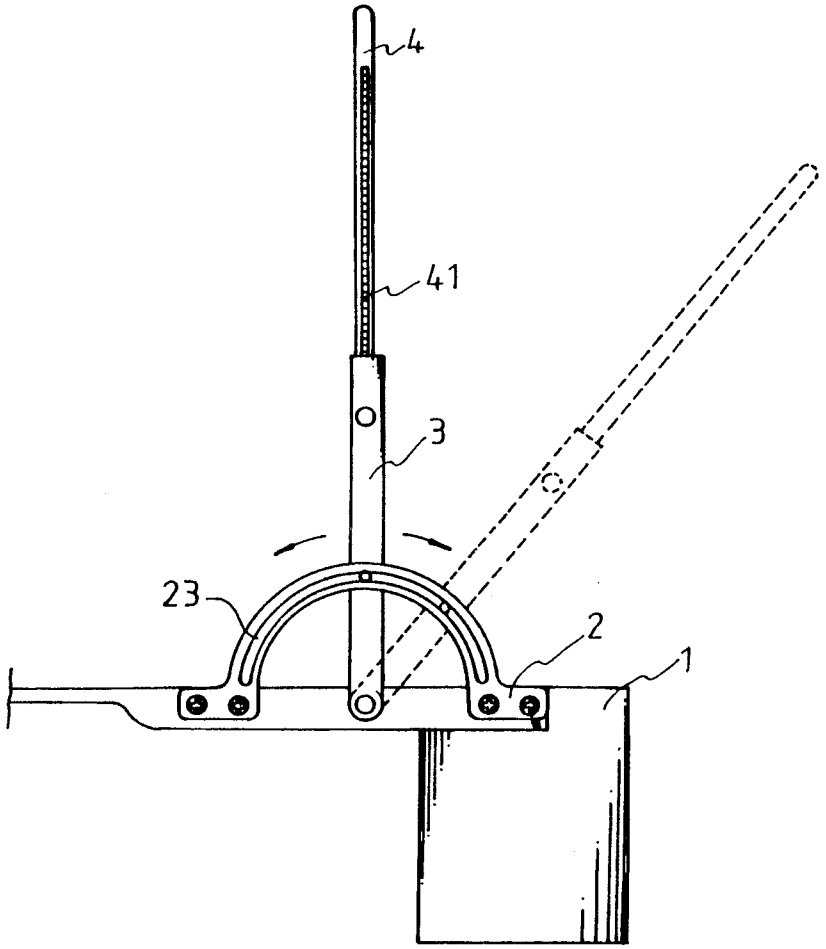
FIG. 3 is a plain view showing that the supporting bar can be rotated on the mounting plate to adjust the angle of the suspension frame relative to the baby's bed.

Referring to FIG. 3, by loosening the wing nut 33 from the screw rod 32 on each supporting bar 3, the suspension frame 4 and the two supporting bars 3 can be rotated on the two opposite pins 13 of the baby's bed 1 within an angle defined by the arched track 23 on each arched mounting plate 2, so that the baby can be conveniently put in the baby's bed 1 or carried away from the baby's bed 1.

Figure 4:
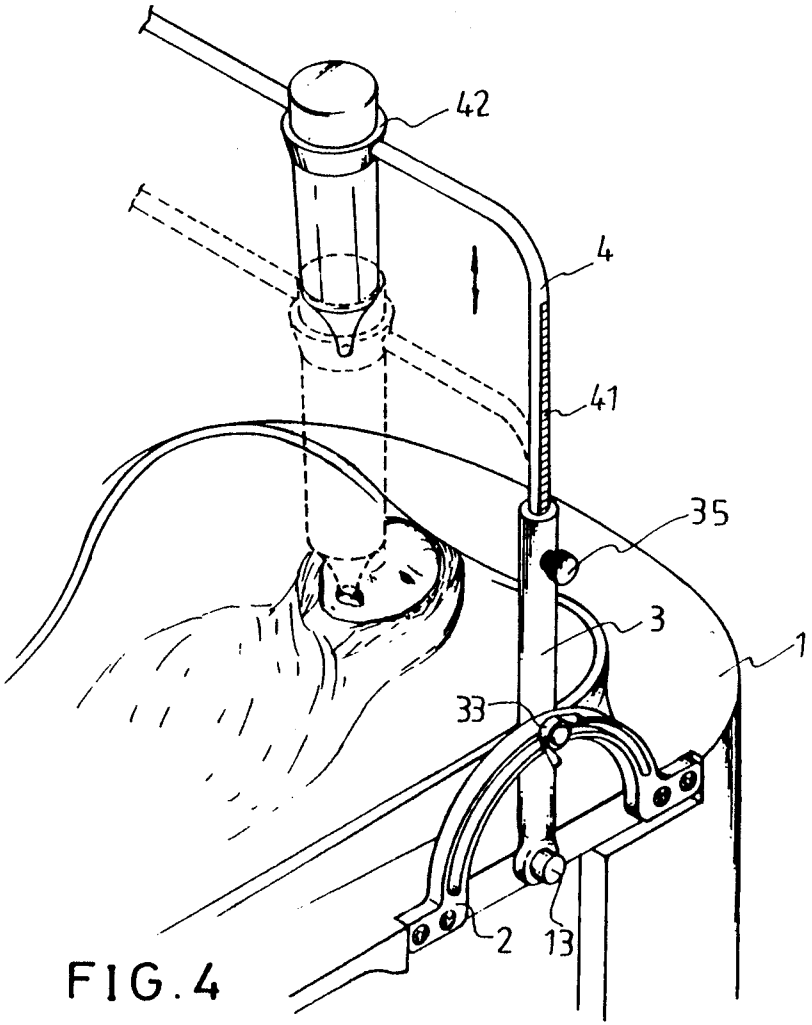
FIG. 4 illustrates that the suspension frame can be adjusted to the desired level for feeding a milk, liquid food, etc. to a baby.

Referring to FIG. 4, by loosening the lock screw 35 on each supporting bar 3, each connecting rod 41 of the suspension frame 4 can be moved in each supporting bar 3 for adjusting the level of the nursing bottle held in the nursing bottle holding ring 42. When adjusted, the lock screw 35 is fastened tight again to lock the suspension frame 4 at the desired level.

I claim:

1. A baby nursing frame assembly comprising:

a baby's bed, said baby's bed having a relatively higher head and a relatively lower foot, two curved supporting flanges raised from a top edge near the head thereof, first and second elongate sides, and an elongated groove in each of said sides near the head thereof, said grooves having each a pin and a plurality of bolt holes;

first and second arched mounting plates, said first arched mounting plate being fastened in one of said grooves, said second arched mounting plate being fastened in the other of said grooves, said arched mounting plates having each a plurality of round holes respectively connected to the bolt holes on said grooves by screws, and an arched sliding track in each of the said arched mounting plates;

first and second supporting bars, said first supporting bar being connected to the first side of said bed and the first arched mounting plate, said second supporting bar being connected to the second side of said bed and the second arched mounting plate, said supporting bars having each a boring bore through a longitudinal axis thereof, and an eye at one end revolvably mounted on the pin on the respective groove, a screw rod inserted through the arched sliding track on the respective arched mounting plate and locked in place by a wing nut, and a bolt hole near a top end thereof, into which a lock screw is threaded; and a suspension frame supported on said two supporting bars to hold a nursing bottle above the head of the baby's bed, said suspension frame comprising a nursing bottle holding ring at a middle section for holding a nursing bottle, and two elongated connecting rods at two opposite ends and at right angles to said middle section, said connecting rods being inserted into the boring bore on the respective supporting bar and locked in place by said lock screw.

* * * * *